US005983980A

United States Patent [19]

Freeman et al.

[11] Patent Number: 5,983,980

[45] Date of Patent: Nov. 16, 1999

[54] CASTING STEEL STRIP

[75] Inventors: John Freeman, Kahibah; Lazar Strezov, Adamstown Heights; Rama Ballav Mahapatra, Yarrawarrah, all of Australia

[73] Assignees: Isahikawajima-Harima Heavy Industries Co., Ltd., Tokyo, Japan; BHP Steel (JLA) Pty. Ltd., Melbourne, Australia

[21] Appl. No.: 09/063,437

[22] Filed: Apr. 21, 1998

Related U.S. Application Data

[62] Continuation-in-part of application No. 08/814,009, Mar. 10, 1997, abandoned, which is a continuation of application No. 08/411,665, filed as application No. PCT/AU94/00685, Nov. 9, 1994, abandoned.

[30] Foreign Application Priority Data

Nov. 18, 1993 [AU] Australia ..... PM2539

[51] Int. Cl.[6] ..... B22D 11/06

[52] U.S. Cl. ..... 164/480; 164/428

[58] Field of Search ..... 164/428, 480, 164/429, 479, 423, 463

[56] References Cited

FOREIGN PATENT DOCUMENTS

| | | | |
|---|---|---|---|
| 2-165849 | 6/1990 | Japan | 164/479 |
| 5-212505 | 8/1993 | Japan | 164/480 |

*Primary Examiner*—Kuang Y. Lin

*Attorney, Agent, or Firm*—Nikaido Marmelstein Murray & Oram LLP

[57] ABSTRACT

Method of continuously casting metal strip from a casting pool of molten metal supported on chilled casting rolls such that metal solidifies onto moving casting surfaces of the rolls. The metal is austenitic stainless steel containing chromium and nickel in a ratio $(Cr/Ni)_{eq}$ of less than 1.60 and the casting surface of each roll has an Arithmetical Mean Roughness Value ($R_a$) of more than 2.5 microns. The heat transferring from the austenitic stainless steel solidifying on the textured surface of the moving casting surface to the casting surface at an initial peak heat transfer rate is more than 15 MW/m within the initial 20 ms of contact.

8 Claims, 20 Drawing Sheets

23
17
18
14
15
4
46
5
5
19
24
3
18
3
16
56
4

CASTING STEEL STRIP

This is a Continuation-In-Part of application Ser. No. 08/814,009 (filed Mar. 10, 1997) now abandoned, which is a Continuation of application Ser. No. 08/411,665 (filed Aug. 10, 1995) now abandoned, which is a 371 of application PCT/AU94/00685 (filed Nov. 9, 1994).

TECHNICAL FIELD

This invention relates to the casting of steel strip. It has particular but not exclusive application to continuous casting of stainless steel strip in a twin roll caster.

It is known to cast metal strip by continuous casting in a twin roll caster. Molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

Twin roll casting has been applied with some success to non-ferrous metals which solidify rapidly on cooling, for example aluminium. Our Australian Patent No 631728 discloses a method and apparatus which enables continuous casting of ferrous strip within 0.5 mm to 5 mm and apparatus of this type has been developed to the stage where it is possible to consistently produce good quality mild steel strip. However there have been particular problems in casting austenitic stainless steel strip because of the marked tendency for such steel to suffer from cracking and repetitive surface depressions appearing as a surface defect generally known as "crocodile skin".

Although it is possible to roll light "crocodile skin" type defects out of the strip by substantial in-line hot rolling to produce a strip surface quality suitable for subsequent cold rolling and further downstream processing, it is preferable to avoid such defects if possible. If those defects can be eliminated, it becomes possible to take full advantage of the twin roll casting process to directly cast thin strip from liquid metal without the need for an in-line hot rolling mill as is required for conventionally cast thicker product. We have undertaken extensive experimental work in which we have determined factors which make it possible consistently to cast austenitic stainless steel strip of good surface quality without significant cracking or "crocodile skin" type defects.

In the ensuing description it will be necessary to refer to a quantitative measure of the smoothness of casting surfaces. One specific measure used in our experimental work and helpful in defining the scope of the present invention is the standard measure known as the Arithmetic Mean Roughness Value which is generally indicated by the symbol $R_a$. This value is defined as the arithmetical average value of all absolute distances of the roughness profile from the centre line of the profile within the measuring length $l_m$. The centre line of the profile in the line about which roughness is measured and is a line parallel to the general direction of the profile within the limits of the roughness-width cut-off such that sums of the areas contained between it and those parts of the profile which lie on either side of it are equal. The Arithmetic Mean Roughness Value may be defined as $$R_a = l/l_m \int_{x=0}^{x=l_m} |y| dx$$

A primary cause of the "crocodile skin" type defects on solidification of austenite is segregation of alloying elements in the steel during initial solidification on the casting surfaces to form the shells which come together at the nip to form the strip. Such segregation causes localised changes in heat transfer rates and consequent strains in the shells at a time when they have not completely solidified and are very weak with the result that they suffer localised distortions producing defects in the strip surface. The tendency for segregation increases as the chrome to nickel ratio is reduced and it has hitherto not been possible to successfully cast steel with a chromium to nickel ratio $(Cr/Ni)_{eq}$ of less than about 1.7 without severe segregation effects. Continuous strip casting of steels with chromium to nickel ratios of this order produces severe "crocodile skin" type defects which becomes more severe as the ratio is lowered and it has thus not hitherto been possible to strip cast austenitic stainless steels without such defects.

Japanese Patent Publication JP05-212505 in the name of Nisshin Steel discloses a method for twin roll casting a two phase stainless steel strip ie. a strip having a structure of austenite and ferrite. To produce such a dual phase strip the chromium to nickel ratio of the steel must be of the order of three or more. When working in this range the liquid steel firstly solidifies to ferrite and there is a subsequent solid transformation into the dual phase ferrite and austenite. JP05-212505 teaches that in order to control this solidification process to a two phase structure while minimizing localised distortions and cracking in the strip surface, the solidification rate should be slowed by forming on the copper or copper alloy casting rolls a thick heat transfer resistant coating having a thickness in the range 1 mm to 3.5 mm. The coating must have a specified thermal conductivity and can be formed by nickel plating or Ni—Fe plating. The upper limit of the coating thickness is chosen on the basis that the heat transfer rate should not be slowed to such extent as to give unacceptably low productivity but the thrust of the disclosure is that the initial heat transfer rate of the casting rolls must be reduced to avoid unevenness in cooling and the formation of cracks. It may be postulated that the effect of slowing down the initial heat transfer rate is to allow initial solidification into ferrite to proceed for long enough to build up a coherent shell which is thick enough to withstand the strains caused on subsequent solid transformation into the two phase structure.

Japanese Publication JP02-165849A in the name of Kawasaki Steel Corporation discloses twin roll casting of thin strip by the use of casting rolls having a composite multi-layered casting surface construction formed with grooves. The multi-layered construction is produced by applying a moderately thick nickel plated layer of the order of 0.2 mm to 0.6 mm on the underlying copper substrate, forming grooves in the nickel plated layer and applying a very thin chromium plated layer over the grooved nickel plated layer. The purpose of this construction is stated to be to avoid dimpling due to delay in solidification and the flow of molten metal laterally across the casting rolls. It is explained that at the beginning of solidification of the solidified layers that are formed upon the rolled surfaces, molten metal invades the grooves and the solidified layers are thus constrained by the grooves against lateral movement with consequent reduction in deformation. It is further explained that the grooves are formed in a nickel plated layer to produce a uniform moderate cooling rate in order to delay solidification of metal in the grooves and so avoid substantial variation between growth of the solidified layer within the grooves and between the grooves which can result in distortion and cracking of the solidified layer. It is moreover stated that the thermal conductivity of the nickel plated layer is lower than that of the underlying copper or copper alloy substrate so as to reduce the cooling rate in order to produce a uniform moderate cooling. It is also stated that it is important that the grooves be formed in the nickel plated layer rather than in the underlying copper substrate in order to achieve precise shaping of the grooves and to prevent peeling of the nickel layer.

Both of the above Japanese publications disclose means for reducing the heat transfer rates at the casting surfaces in a twin roll caster through the use of heat resistant coatings applied over the copper or copper alloy cooling surface substrates. However, we have determined that by positively promoting very high initial heat transfer rates at the casting surfaces it is possible to suppress segregation during initial solidification and this permits thin strip casting of steels with a chromium to nickel ratio much lower than previously thought possible and to the extent that it is possible to cast austenitic stainless steel without significant segregation problems and "crocodile skin" type defects.

DISCLOSURE OF THE INVENTION

The invention provides in a method of casting steel strip comprising:

forming a casting pool of molten steel in contact with a moving casting surface having a substrate consisting primarily of copper;

moving said casting surface relative to said casting pool;

solidifying steel from said casting pool on said moving casting surface; and taking solidified steel away from said moving casting surface;

the improvement comprising;

providing steel comprising austenitic stainless steel containing chromium and nickel in a ratio $(Cr/Ni)_{eq}$ of less than 1.6 in said casting pool;

contacting said austenitic stainless steel in said pool with said moving casting surface having a textured surface which has an Arithmetic Mean Roughness Value ($R_a$) of more than 2.5 microns provided by applying a texture to the substrate; and transferring heat from said austenitic stainless steel solidifying on said textured surface of said moving casting surface to said casting surface at an initial peak heat transfer rate of more than 15 $MW/m^2$ wherein MW is megawatt and m is meter, within the initial 20 ms wherein ms is millisecond, of contact, said heat transfer rate being sufficiently high to enable the solidification of said steel on said surface without deleterious segregation and surface cracking.

Preferably, said texture is applied by cutting into or indenting the primarily copper substrate and covering the so formed textured surface with a thin protective coating which follows and preserves the texture.

Preferably further, said texture is applied by forming in the substrate parallel groove and ridge formations of essentially constant depth and pitch, the depth of the texture from ridge peak to groove root being in the range 10 microns to 60 microns, and said pitch being in the range 100 microns to 200 microns.

It is preferred that the carbon, chromium and nickel contents of the steel be in the following ranges:

| | |
|---|---|
| Carbon | 0.04–0.06% by weight |
| Chromium | 17.5–19.5% by weight |
| Nickel | 8.0–10.0% by weight. |

BRIEF DESCRIPTION OF THE DRAWINGS

In order that the invention may be more fully explained its application to the production of stainless steel strip in a twin roll continuous caster will be explained with reference to the accompanying drawings in which.

DETAILED DESCRIPTION OF THE PREFERRED EMBODIMENT

Figure 1:
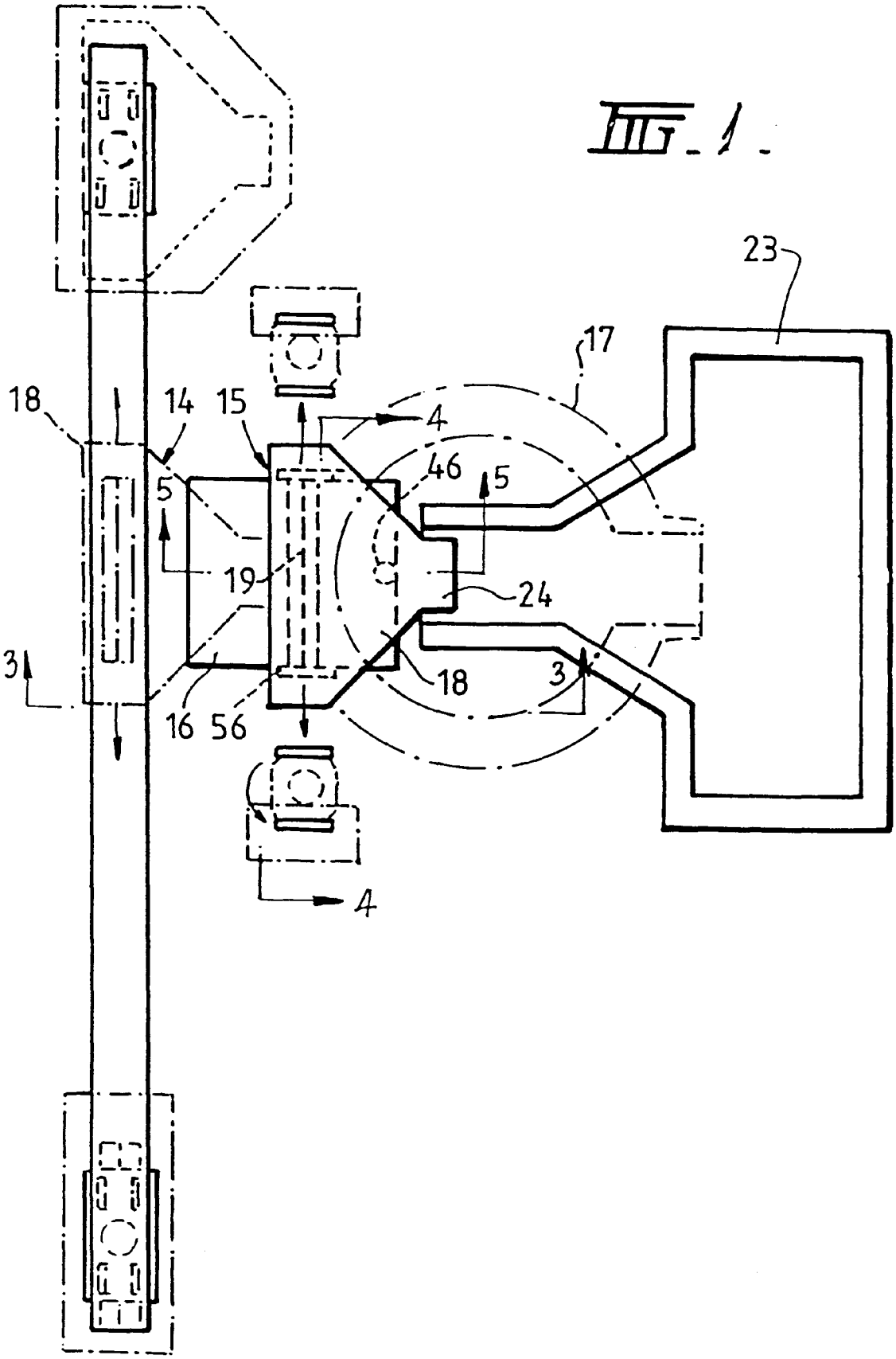
FIG. 1 is a plan view of a twin roll continuous strip caster which may be operated in accordance with the present invention.
Figure 2:
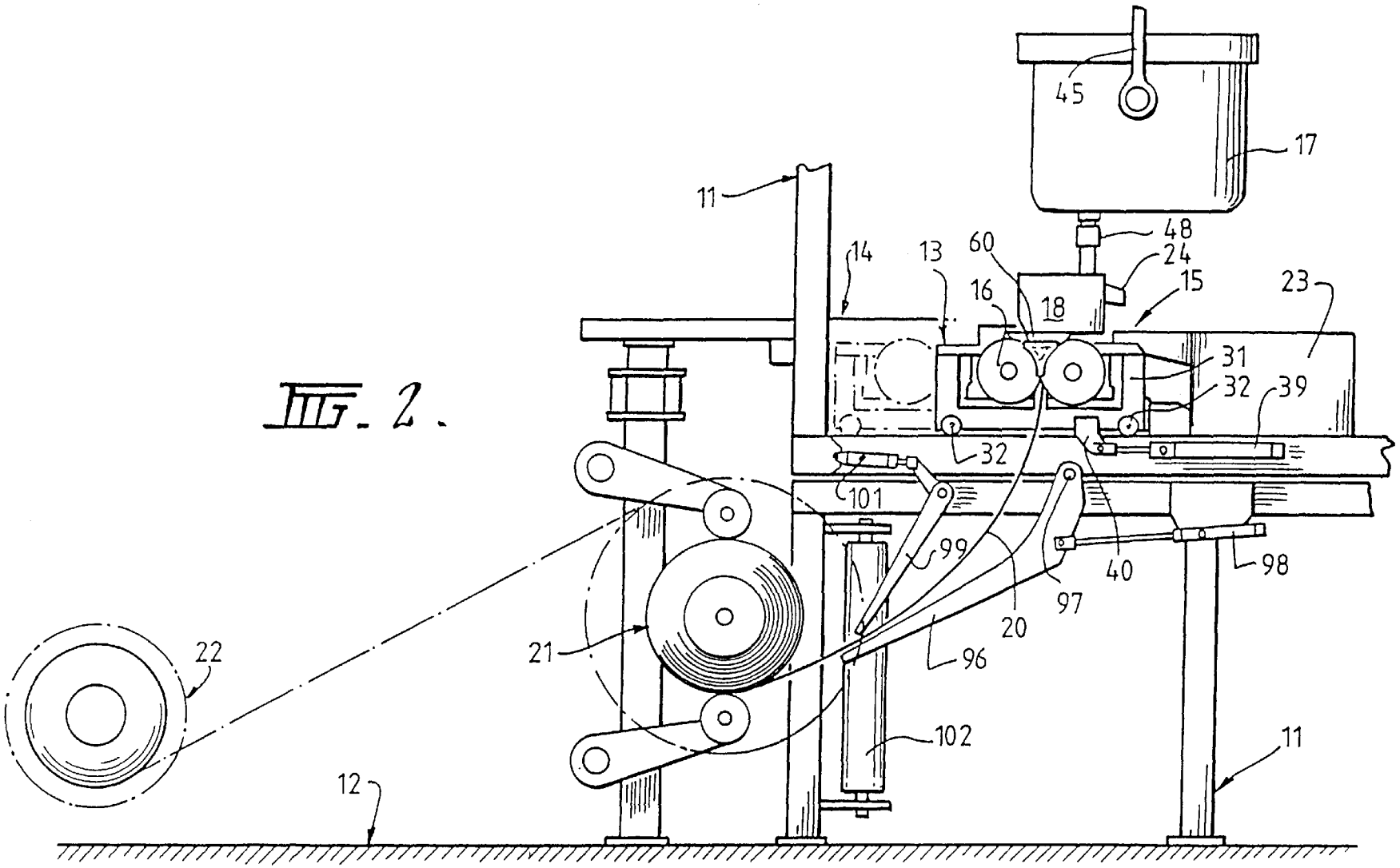
FIG. 2 is a side elevation of the strip caster shown in FIG. 1.
Figure 3:
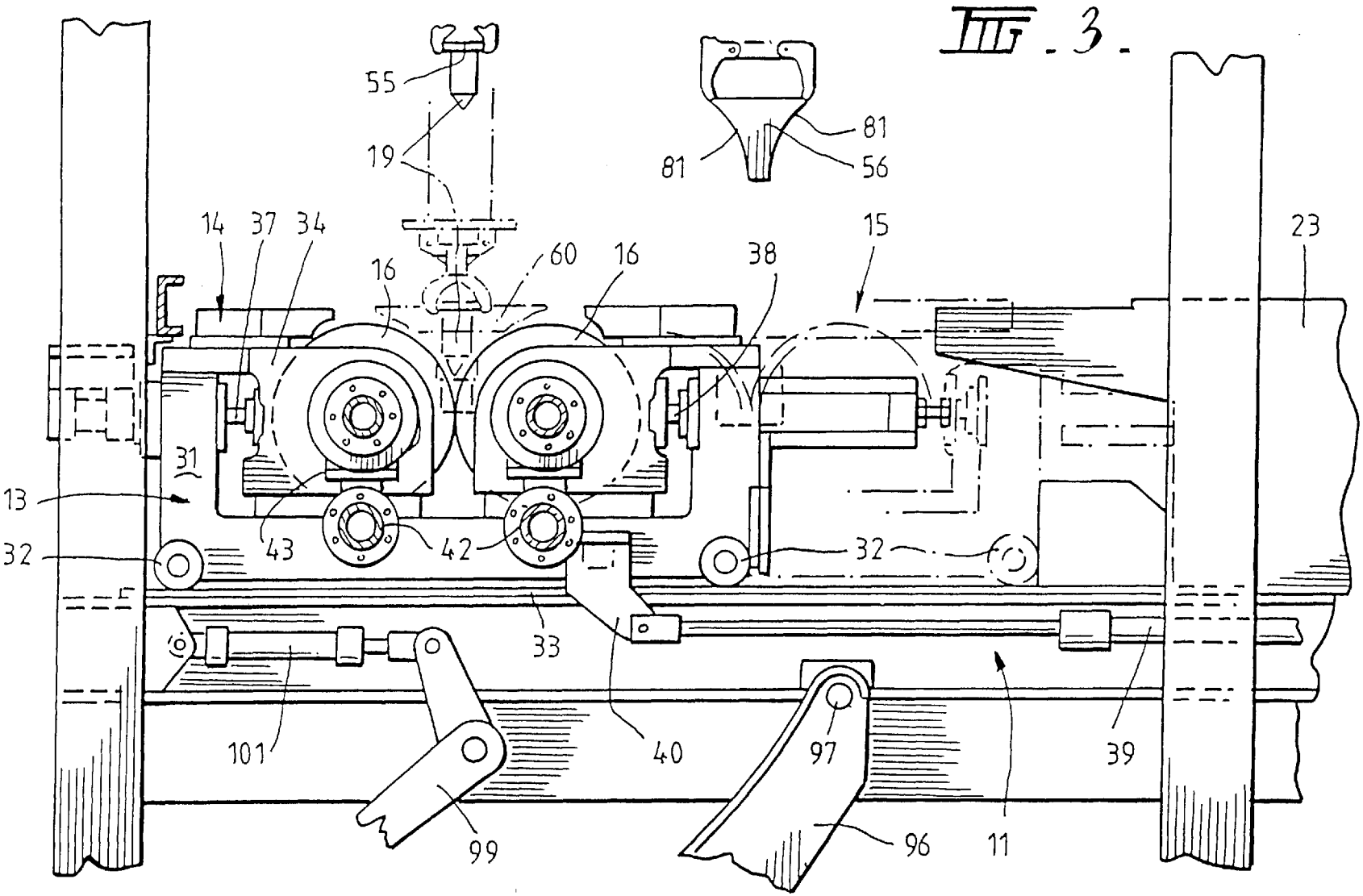
FIG. 3 is a vertical cross-section on the line 3—3 in FIG. 1.
Figure 4:
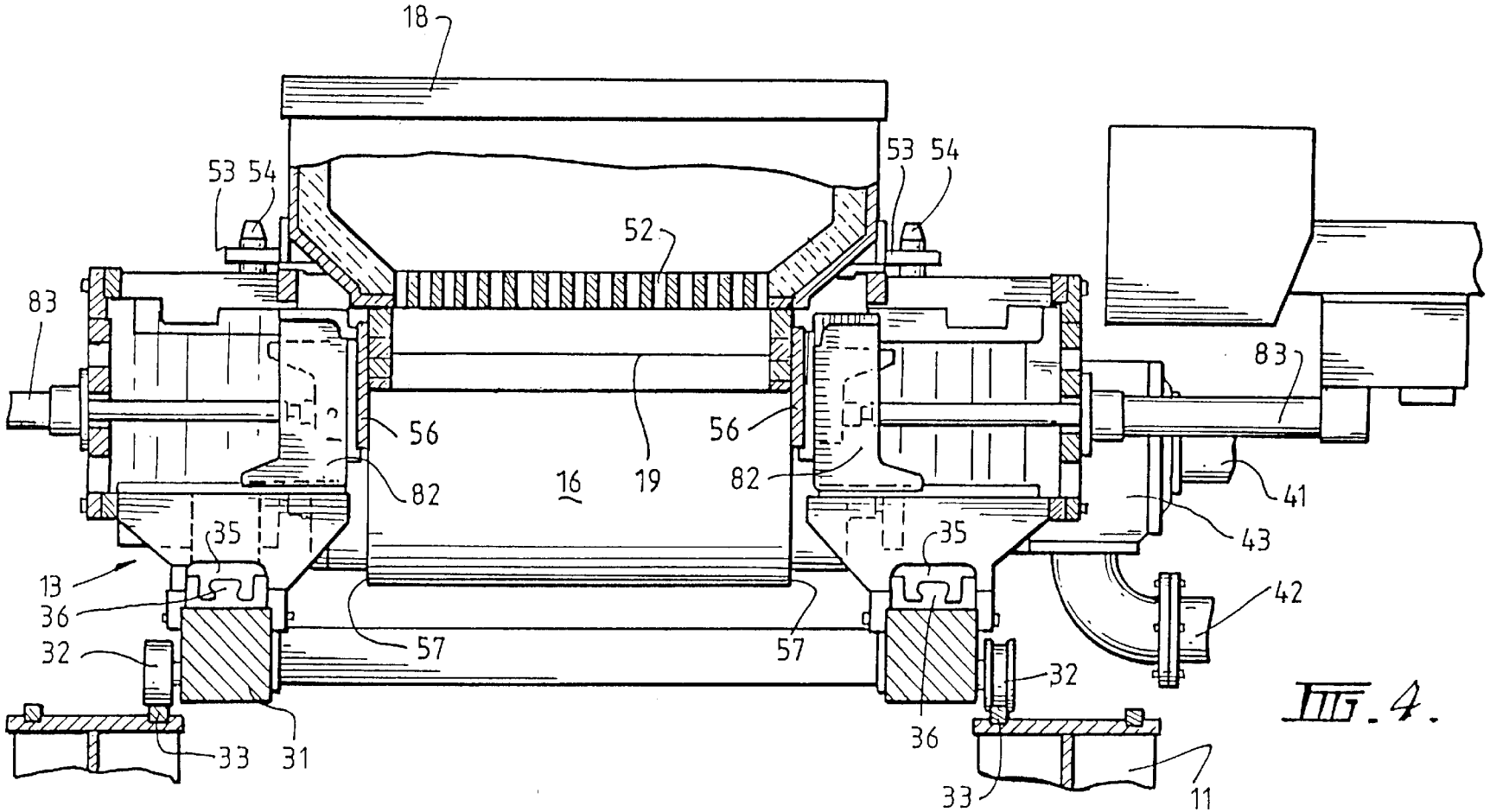
FIG. 4 is a vertical cross section on the line 4—4 in FIG. 1.
Figure 5:
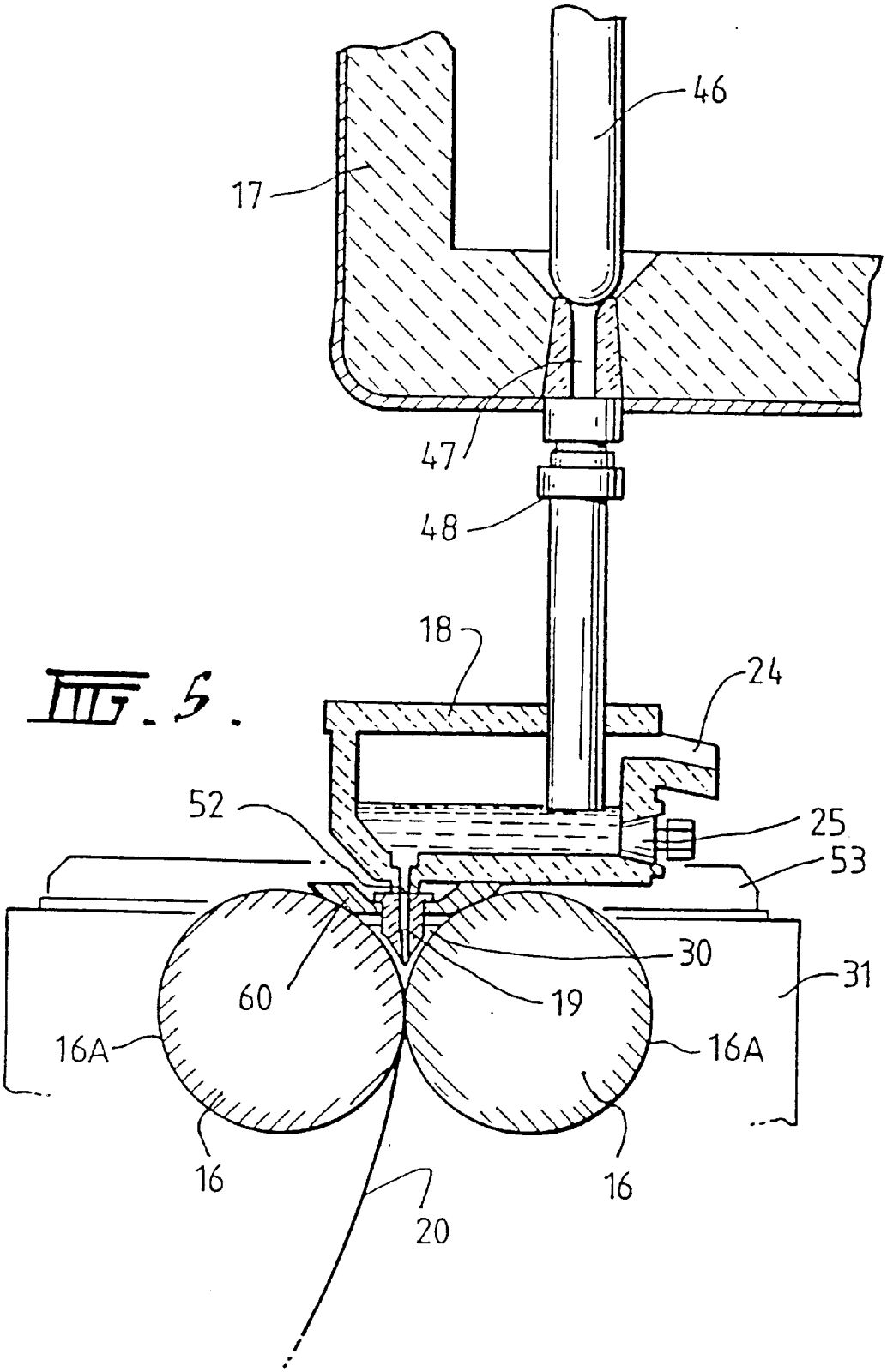
FIG. 5 is a vertical cross-section on the line 5—5 of FIG. 1.

The illustrated caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a tundish 18 and delivery nozzle 19. Casting rolls 16 are water cooled so that shells solidify on the moving roll surfaces and are brought together at the nip between them to produce a solidified strip product 20 at the roll outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Roll cradles 34 are mounted on the carriage frame 31 by interengaging complementary slide members 35, 36 to allow the cradles to be moved on the carriage under the influence of hydraulic cylinder units 37, 38 to adjust the nip between the casting rolls 16. The carriage is movable as a whole along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The rolls may typically be about 500 mm diameter and up to 1300 mm long in order to produce 1300 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as magnesium oxide (MgO). One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roll carriage frame 31 and provided with apertures to receive indexing pegs 54 on the carriage frame so as to accurately locate the tundish.

Delivery nozzle 19 is formed as an elongate body made of a refractory material such as alumina graphite. Its lower part is tapered so as to converge inwardly and downwardly so that it can project into the nip between casting rolls 16. It is provided with a mounting bracket 60 whereby to support it on the roll carriage frame and its upper part is formed with outwardly projecting side flanges 55 which locate on the mounting bracket.

Nozzle 19 may have a series of horizontally spaced generally vertically extending flow passages to produce a suitably low velocity discharge of metal throughout the width of the rolls and to deliver the molten metal into the nip between the rolls without direct impingement on the roll surfaces at which initial solidification occurs. Alternatively, the nozzle may have a single continuous slot outlet to deliver a low velocity curtain of molten metal directly into the nip between the rolls and/or it may be immersed in the molten metal pool.

The pool is confined at the ends of the rolls by a pair of side closure plates 56 which are held against stepped ends 57 of the rolls when the roll carriage is at the casting station. Side closure plates 56 are made of a strong refractory material, for example boron nitride, and have scalloped side edges 81 to match the curvature of the stepped ends 57 of the rolls. The side plates can be mounted in plate holders 82 which are movable at the casting station by actuation of a pair of hydraulic cylinder units 83 to bring the side plates into engagement with the stepped ends of the casting rolls to form end closures for the molten pool of metal formed on the casting rolls during a casting operation.

During a casting operation the ladle stopper rod 46 is actuated to allow molten metal to pour from the ladle to the tundish through the metal delivery nozzle whence it flows to the casting rolls. The clean head end of the strip product 20 is guided by actuation of an apron table 96 to the jaws of the coiler 21. Apron table 96 hangs from pivot mountings 97 on the main frame and can be swung toward the coiler by actuation of an hydraulic cylinder unit 98 after the clean head end has been formed. Table 96 may operate against an upper strip guide flap 99 actuated by a piston and a cylinder unit 101 and the strip product 20 may be confined between a pair of vertical side rollers 102. After the head end has been guided in to the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster.

It has been found in the operation of the above described apparatus that it is possible to consistently produce good austenitic stainless steel strip by careful adjustment of the steel chemistry in combination with the use of rolls having textured surfaces to minimise segregation through initial rapid cooling rates.

In austenitic stainless steel strip casting, solidification mode can play an important part in determining strip surface quality. Primary austenitic solidification mode which occurs when the Cr/Ni ratio is less than about 1.60 is not usually recommended as segregation is enhanced leading to an increase in cracking tendency. It has previously been thought necessary to ensure a Cr/Ni ratio within the range 1.7 to 1.9 in order to minimise cracks due to a reduction in segregation severity and to provide tortuous paths making crack propagation difficult. However our experimental work has shown that continuous strip casting with steel of this composition is very prone to produce strips with "crocodile skin" depressions and the depression severity may be so high as to cause cracking. Steel with Cr/Ni ratio less than 1.55 is most prone to segregation and can thus increase cracking. If solidification occurs on a smooth substrate initial heat transfer rates are low and the solidification structure is coarse resulting in segregation and cracking. However we have determined that this tendency to segregation and cracking can be overcome by ensuring a high initial heat transfer rate and this can most readily be achieved by using a textured substrate, for example by the machining of ridges in the substrate surface.

Initial experimental work was carried out in a metal solidification test rig in which a 40 mm×40 mm chilled block is plunged into a bath of molten steel at such a speed as to closely simulate the conditions at the casting surfaces of a twin roll caster. Steel solidifies onto the chilled block as it moves through the molten bath to produce a layer of solidified steel on the surface of the block. The thickness of this layer can be measured at points throughout its area to map variations in the solidification rate and therefore the effective rate of heat transfer at the various locations. It is thus possible to produce an overall solidification constant, generally indicated by the symbol K, as well as a map of individual values throughout the solidified strip. It is also possible to examine the micro structure of the strip surface to correlate changes in the solidification micro structure with the changes in the observed heat transfer values.

The nature of the experimental work and the results obtained will now be described.

EXPERIMENTAL CONDITIONS

Figure 6:
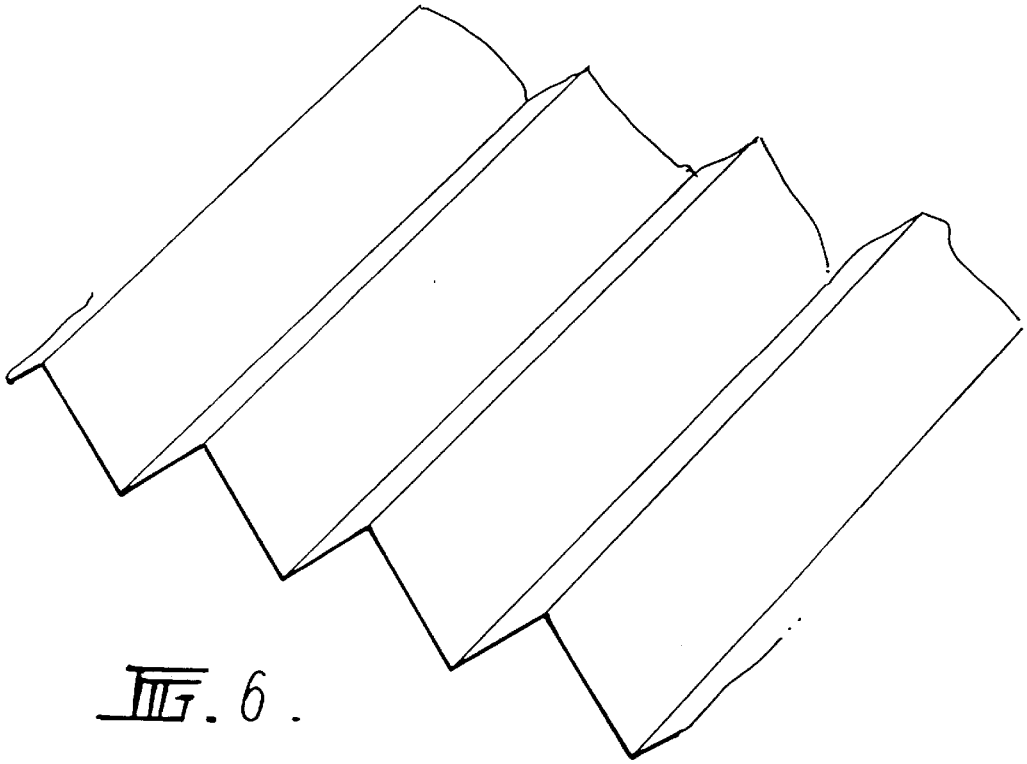
FIG. 6 illustrates the textured surface of a casting surface used in a series of trial casts.

Tests were conducted on three copper substrates with different surface characteristics; a smooth and a textured copper surface and a Cr coated (100 mm in thickness), ground surface. Texture was imparted to the copper block by machining longitudinal grooves and ridges with geometry shown schematically in FIG. 6. Each of these blocks was instrumented with thermocouples to characterise the heat transfer rates prevailing during solidification. In order to maintain consistent casting conditions throughout the experiments, variables such as melt superheat and block temperature were kept constant within reasonable limits. The melt temperature was aimed at about 1525° C. corresponding to a superheat of 75° C. Argon gas introduced into the furnace was quite effective in preventing chemical interaction of the melt with the surrounding atmosphere. The melt chemistry was adjusted to achieve the desired $(Cr/Ni)_{eq}$ ratios, primarily through additions of Cr, Ni, C and $N_2$. The following expressions were used to determine $Cr_{eq}$ and $Ni_{eq}$:

$$Cr_{eq}=Cr+1.37Mo+1.50Si+2.0Nb+3.0Ti \quad (1)$$

$$Ni_{eq}=Ni+0.31Mn+22.0C+14.2N+Cu \quad (2)$$

A summary of the test conditions is contained in Table 1. The entire experimental program comprised approximately 45 tests with $(Cr/Ni)_{eq}$ ratios varying between 1.55 and 1.74. Salient features of various tests are summarised in Table 2.

TABLE 1

Experimental conditions

| | |
|---|---|
| Substrate surface | Smooth copper<br>Cr plated (ground) copper<br>Textured copper (150μm pitch, 20μm depth) |
| Substrate cleaning procedure | Bristle brush and air blowing |
| Melt temperature | 1525° C. |
| Block temperature | 125° C. |

TABLE 2

Details of the various tests

| CONDITION | $(Cr/Ni)_{eq}$ | MELT $N_2$ | GAS ATM | TOTAL DIPS |
|---|---|---|---|---|
| 1 | 1.56–1.71 | 0.047 | Ar | 9 |
| 2 | 1.58–1.71 | 0.037 | Ar | 9 |
| 3 | 1.57–1.61 | <0.062 | $N_2$ | 7 |
| 4 | 1.59 | 0.062 | Ar | 7 |
| 5 | 1.74 | ~ | Ar<br>Ar + He | 15 |

RESULTS

Effect of $(Cr/Ni)_{eq}$ Ratio on Strip Surface Quality

Figure 9:
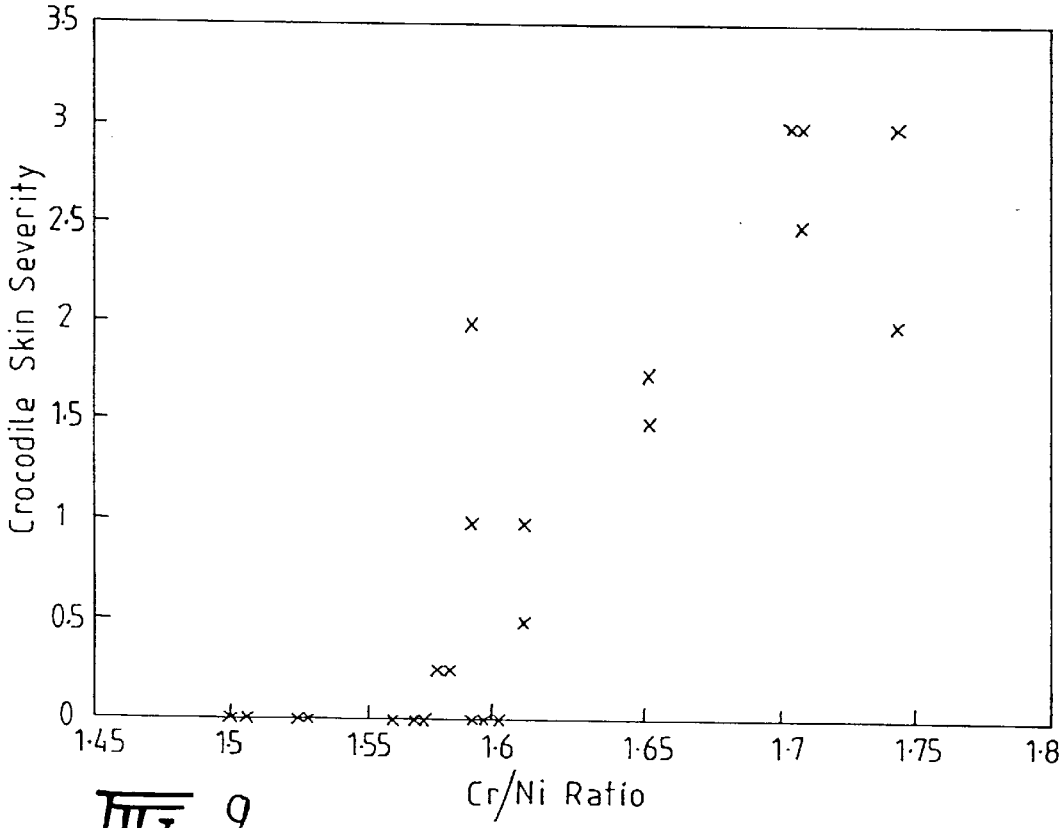
FIGS. 7 to 9 illustrate the results of the trial casts using steels of varying compositions.

Visual examination of the samples revealed that $(Cr/Ni)_{eq}$ ratio has a direct influence on the surface quality of the strip obtained with a textured substrate, however, no noticeable effect could be seen with the smooth substrates. Samples cast at varying $(Cr/Ni)_{eq}$ ratio, reveal a gradual progression from a severe crocodile skin type texture to a smooth surface texture with decreasing $(Cr/Ni)_{eq}$ ratio. The effect of $(Cr/Ni)_{eq}$ ratio on crocodile skin severity, shown in FIG. 9, suggests that substantial improvements in strip surface quality can be achieved by keeping the $(Cr/Ni)_{eq}$ ratio less than 1.60.

Figure 7:
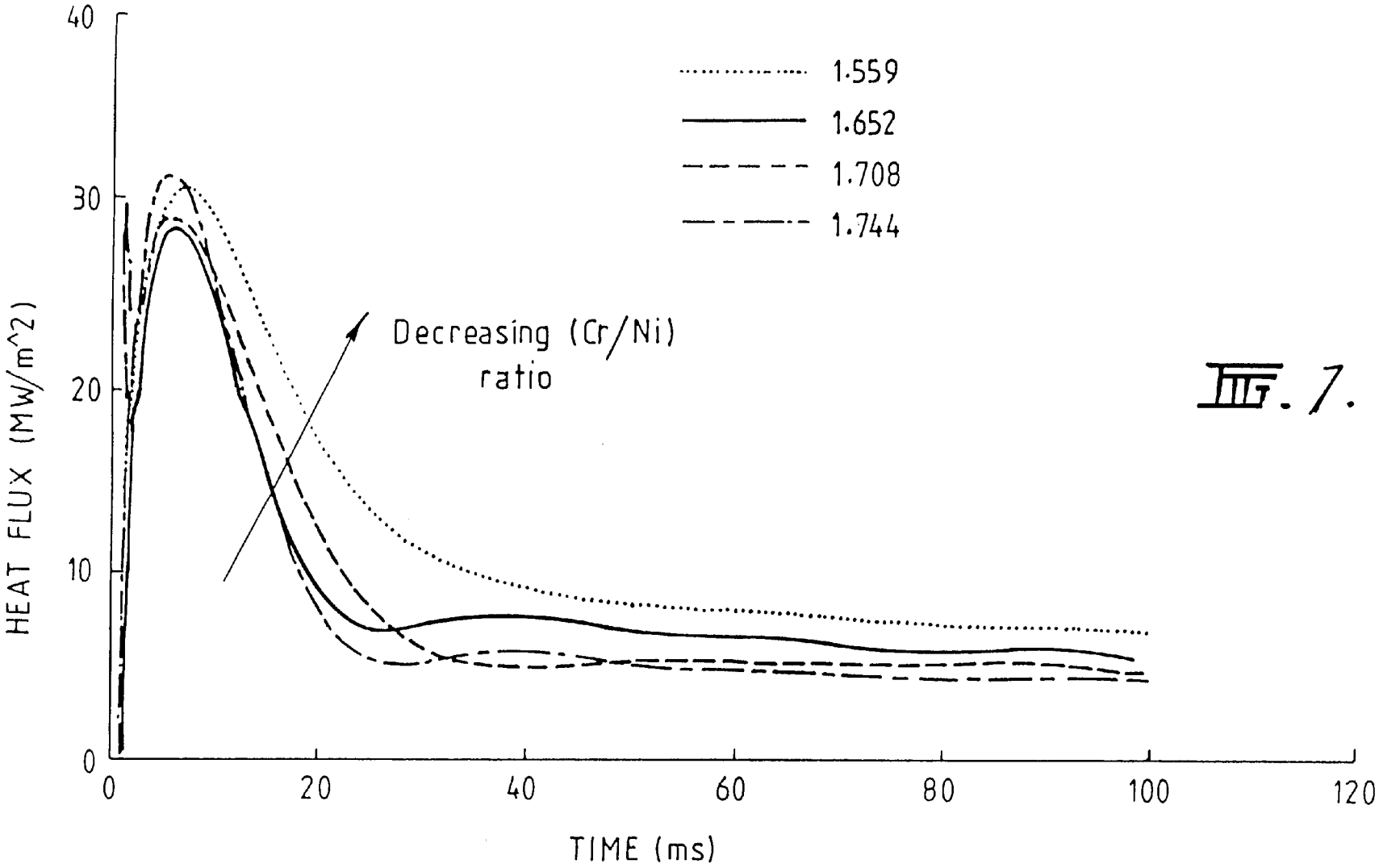

Effect of $(Cr/Ni)_{eq}$ Ratio on Heat Transfer During Solidification i) Textured substrate Heat transfer rates from the strip surface to the substrate were determined from the measured substrate temperatures. FIG. 7 shows the influence of melt $(Cr/Ni)_{eq}$ ratio on heat fluxes for a textured substrate. It can be seen that the profiles are characterised by an early peak in the heat flux followed by rapid reduction of this peak and with increasing time, heat flux approaches a constant value. Higher heat transfer rates (about 30 $MW/m^2$) encountered in the early stages of solidification can be attributed to the intimate contact.

The experimental program determined that the $(Cr/Ni)_{eq}$ ratio found to producing the best surface texture (on a textured substrate) is less than 1.60.

ii) Smooth substrate

Figure 8:
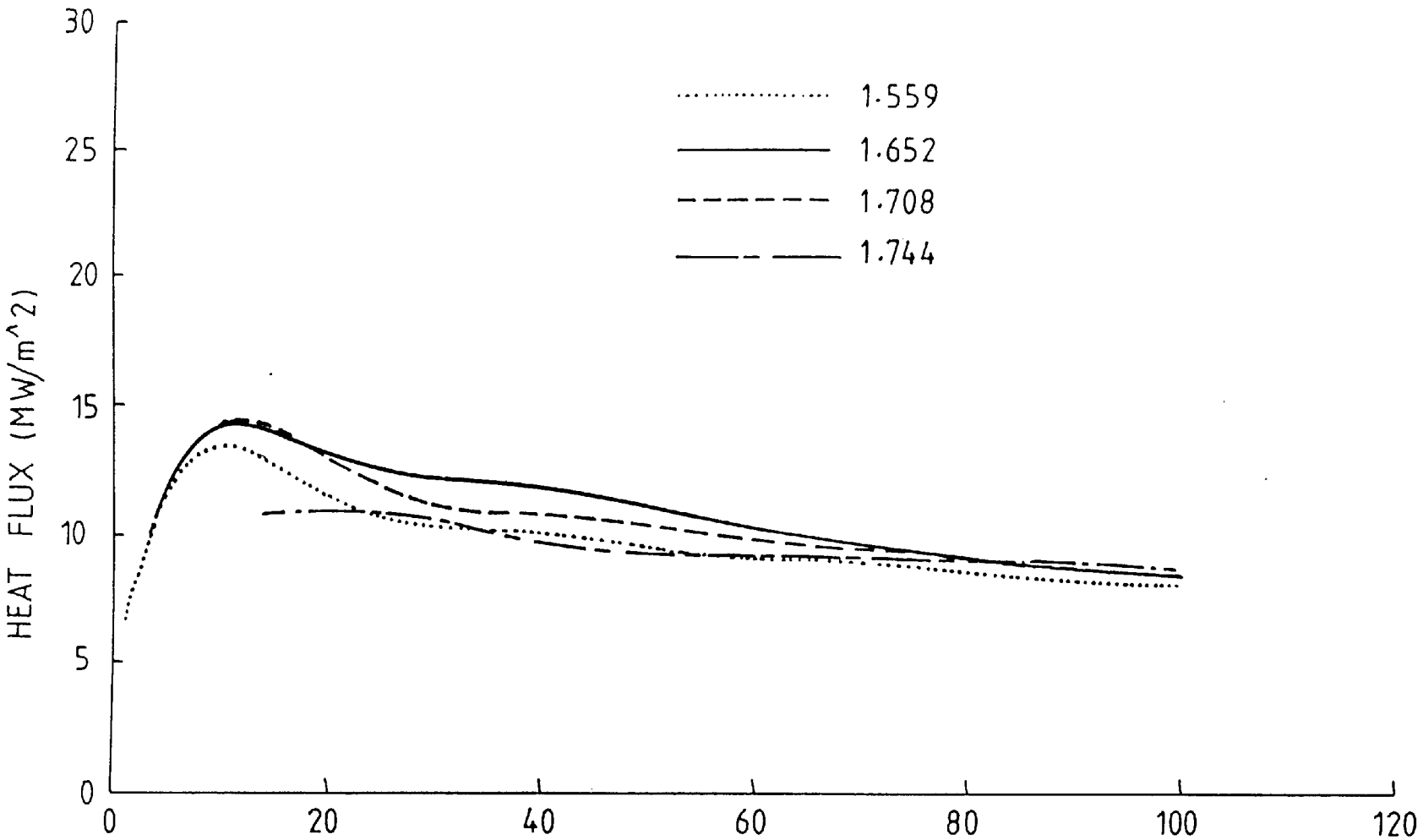

FIG. 8 reveals the influence of $(Cr/Ni)_{eq}$ ratio on heat transfer for a smooth substrate. It can be seen that the heat fluxes are relatively constant throughout solidification and most importantly, the magnitudes of the peak fluxes are much lower than those measured for a textured substrate (FIG. 7). This finding is in agreement with the observed solidification structure which is coarse at the surface. Although there are some variations in heat flux at different $(Cr/Ni)_{eq}$ ratios, there are no definite trends. However, with increasing time the heat fluxes approach similar values irrespective of $(Cr/Ni)_{eq}$. This apparent lack of dependence of heat transfer on $(Cr/Ni)_{eq}$ ratio with a smooth substrate is in agreement with the observations of strip surface texture which was not influenced by $(Cr/Ni)_{eq}$.

The experimental program demonstrated that the normal operating window for $(Cr/Ni)_{eq}$ ratios of 1.7–1.9 is not the optimum in terms of strip surface texture. Using a $(Cr/Ni)_{eq}$ ratio less than 1.60 produces better surface quality.

FIGS. 10 to 21 show the results of x-ray mapping of samples produced on the metal solidification test rig which simulates the conditions of a thin strip caster. The tests used three differing melt chemistries having $(Cr/Ni)_{eq}$ ratios of 1.52, 1.64 and 1.72 respectively. Two solid samples obtained from each of these melts were examined, one being deposited on a textured substrate having a grooved texture shown in FIG. 6 and the other being deposited on a smooth substrate. For each melt both the textured substrate and the smooth substrate were mounted together on the test rig and dipped simultaneously into the molten bath to produce both samples under precisely the same conditions, except for the differing texture of the substrates. The solidified samples were sectioned and the section surface transverse to the chill surface was subjected to x-ray mapping to measure the concentration of Cr and Ni along lines parallel to the chill surface and therefore across the dendrites in the sample at varying depths from the chill surface. FIGS. 10 to 15 show the result of these x-ray mapping measurements to a depth of 100 microns from the chill surface (designated the "chill line" in the figures since the results were obtained from a two dimensional section through each sample).

In FIGS. 10 to 15 the variations in Ni and Cr content about mean value is an indication of the microsegregation of these elements in the surface region of the samples to a depth of 100 microns. FIGS. 16 to 21 provide a measure of those variations by plotting the standard deviations of the Ni and Cr content measurements for each sample against the depth from the chill surface of chill line in each case.

Figure 10:
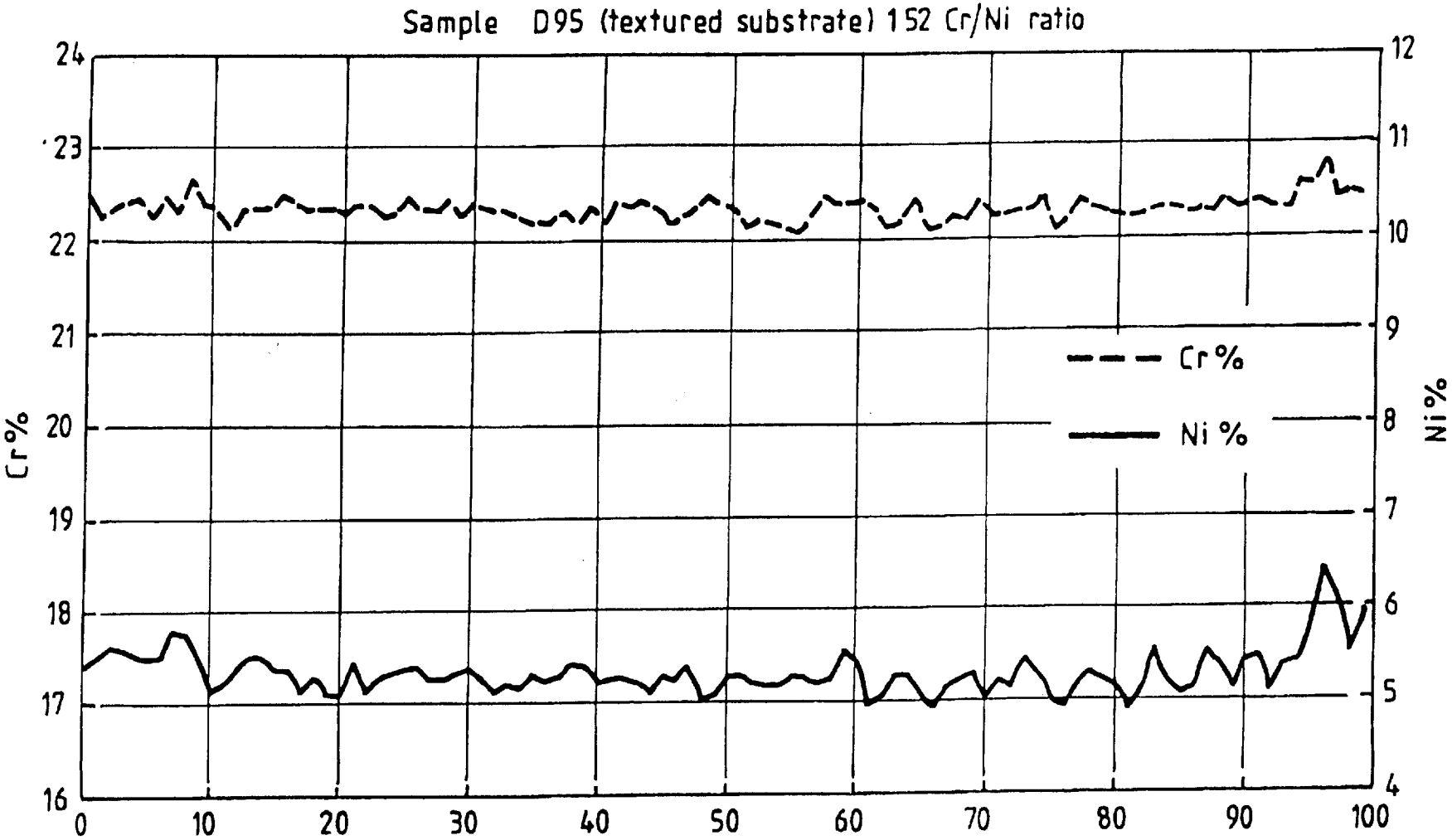
FIGS. 10 to 21 show the results of x-ray mapping of samples produced on the metal solidification test rig which simulates the conditions of a thin strip caster.
Figure 11:
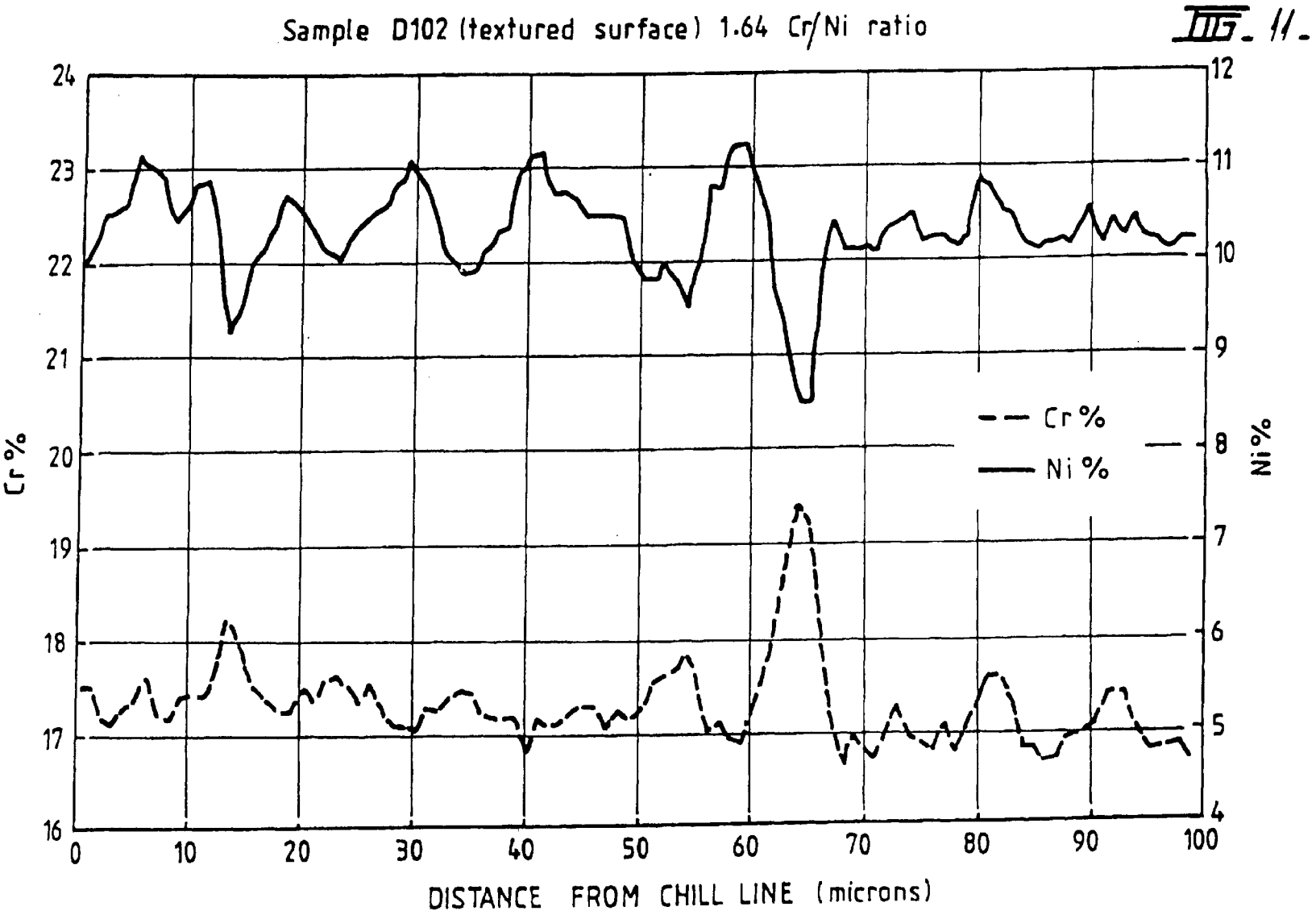
Figure 12:
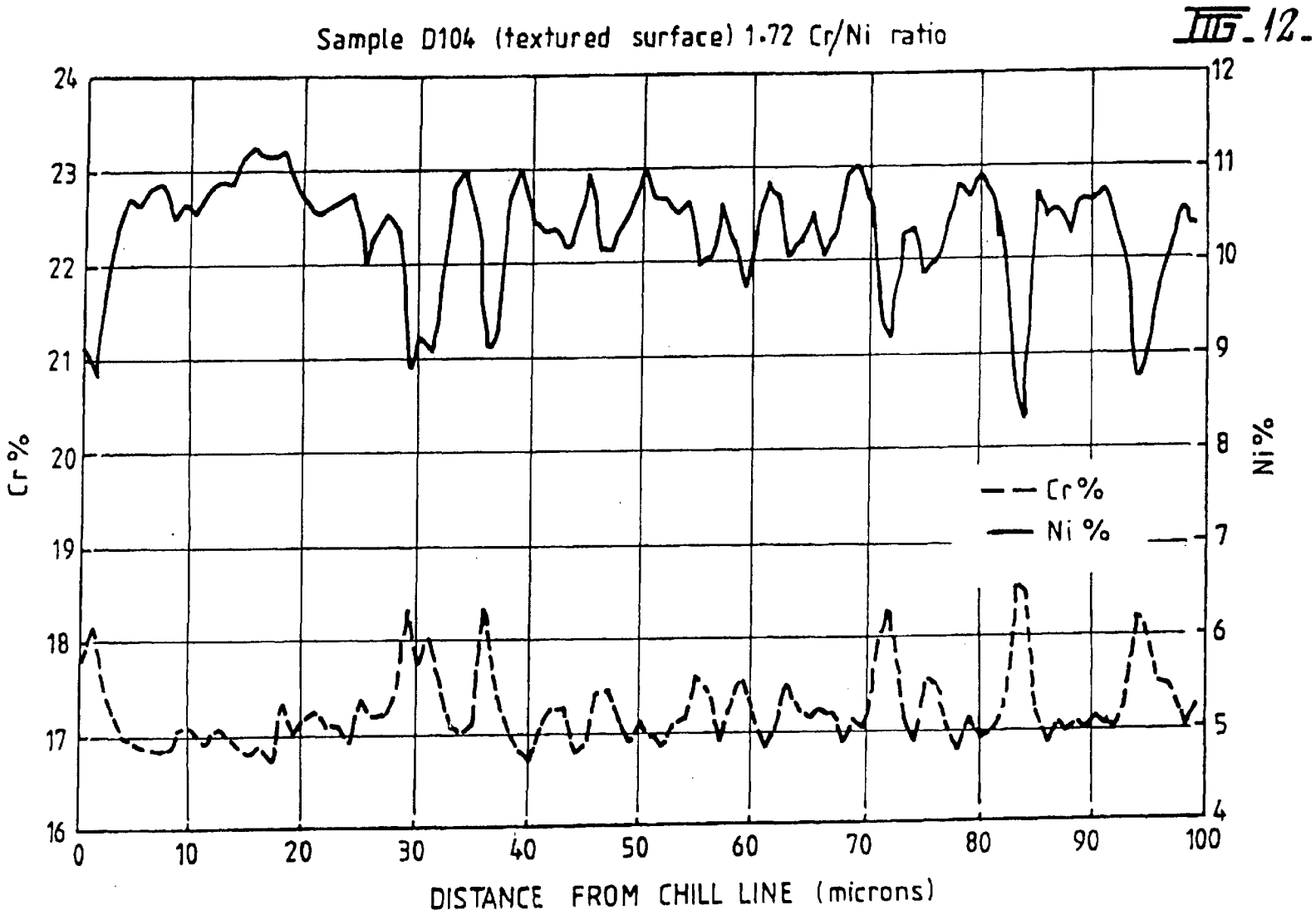
Figure 13:
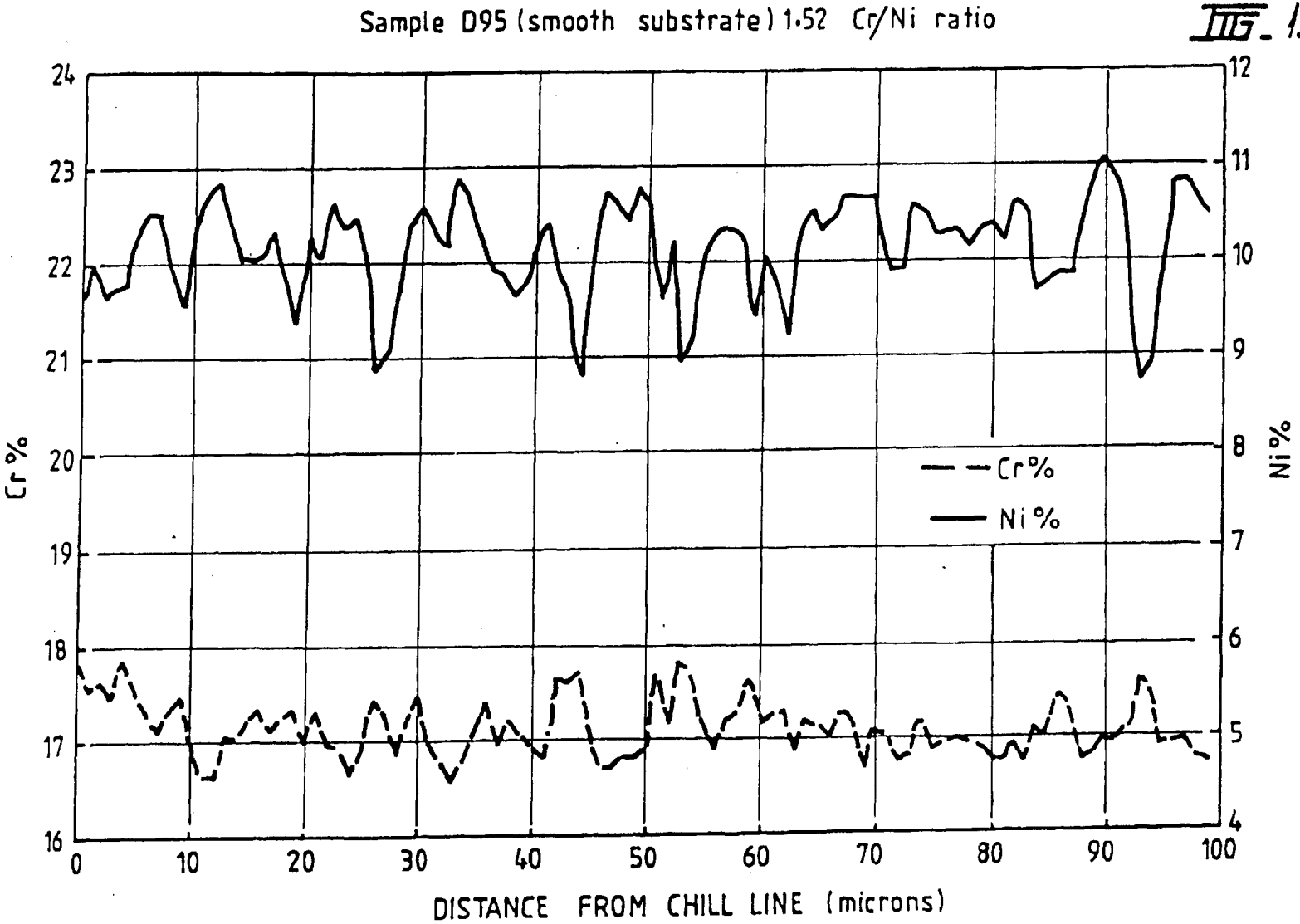
Figure 14:
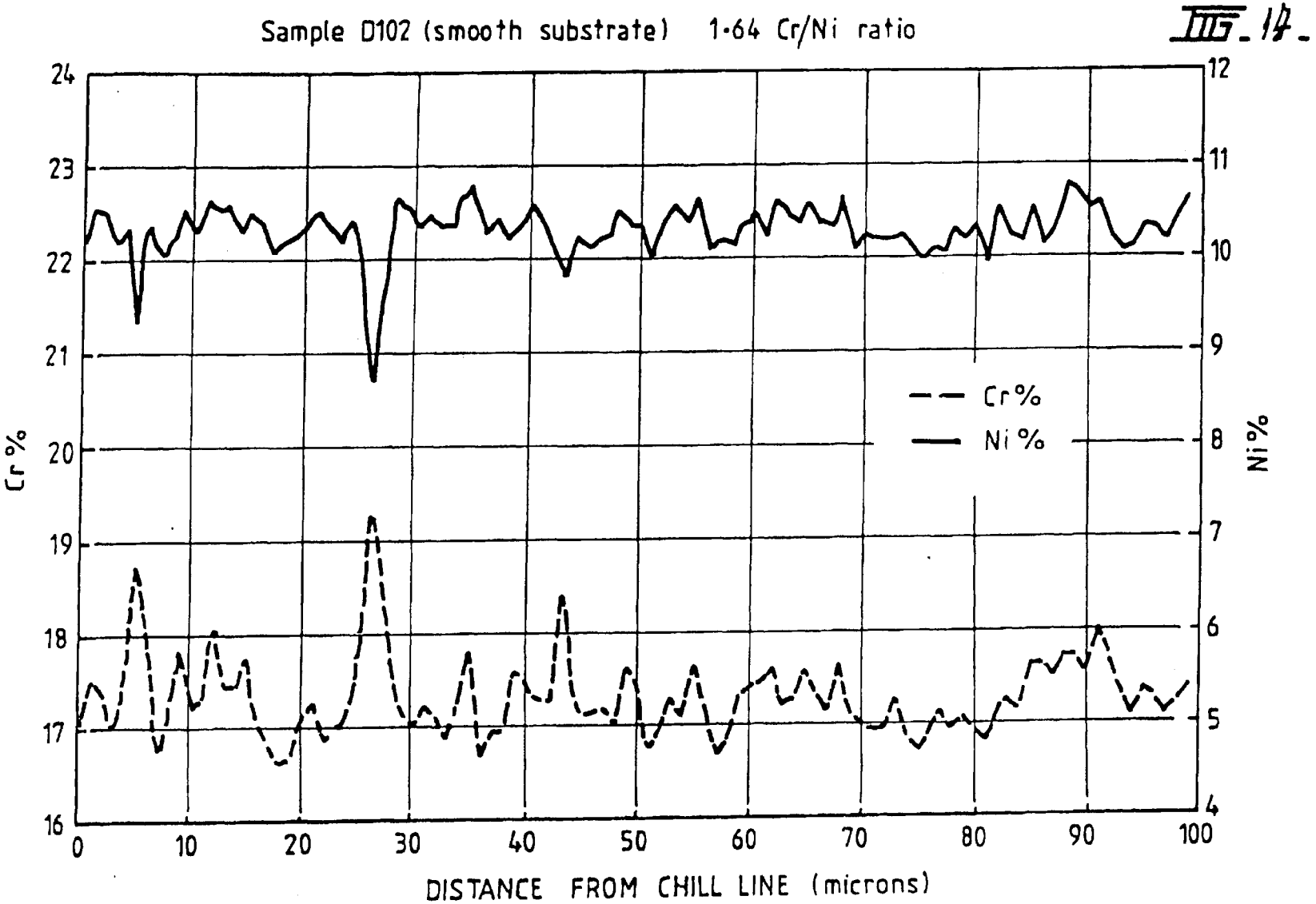
Figure 15:
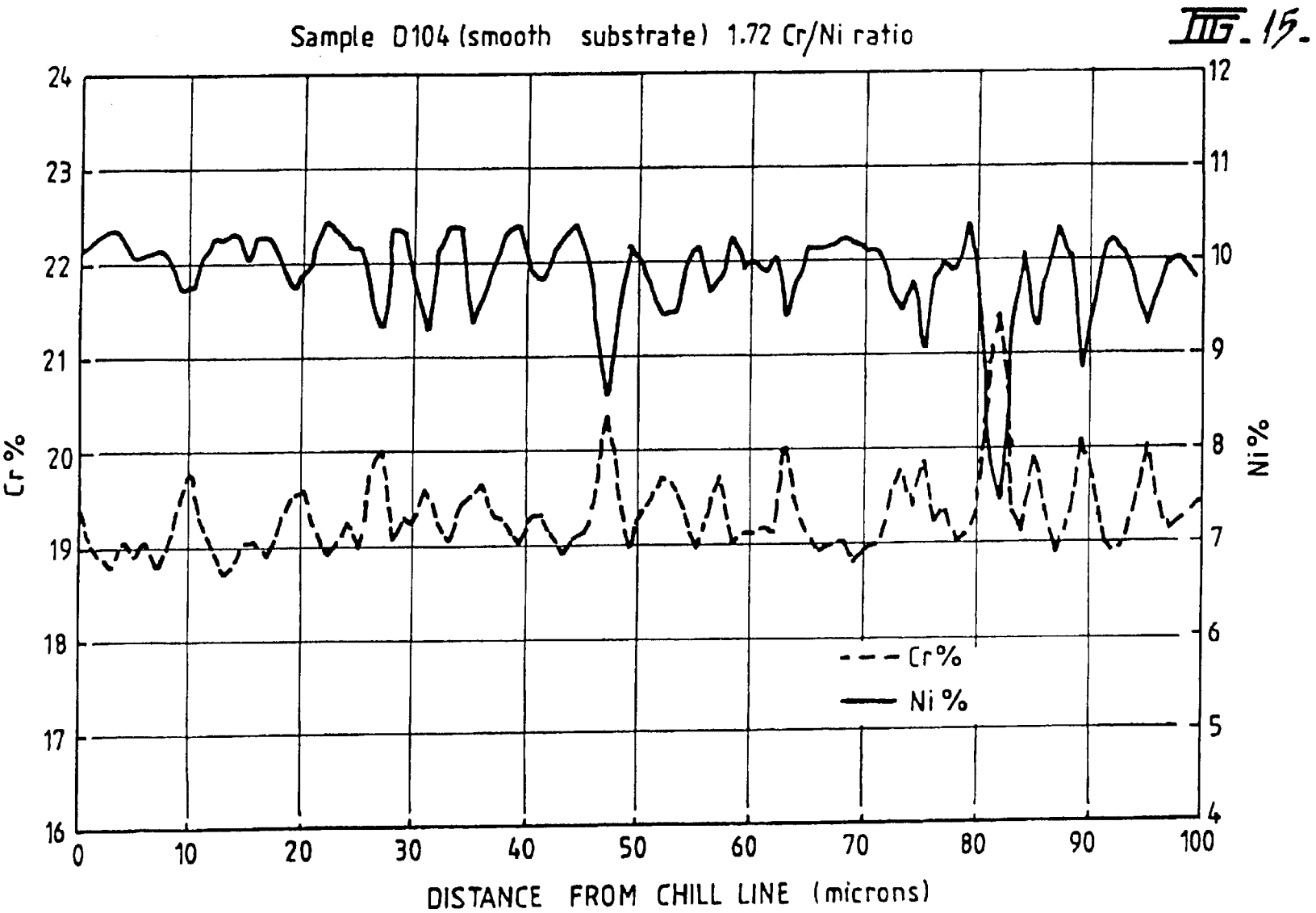
Figure 16:
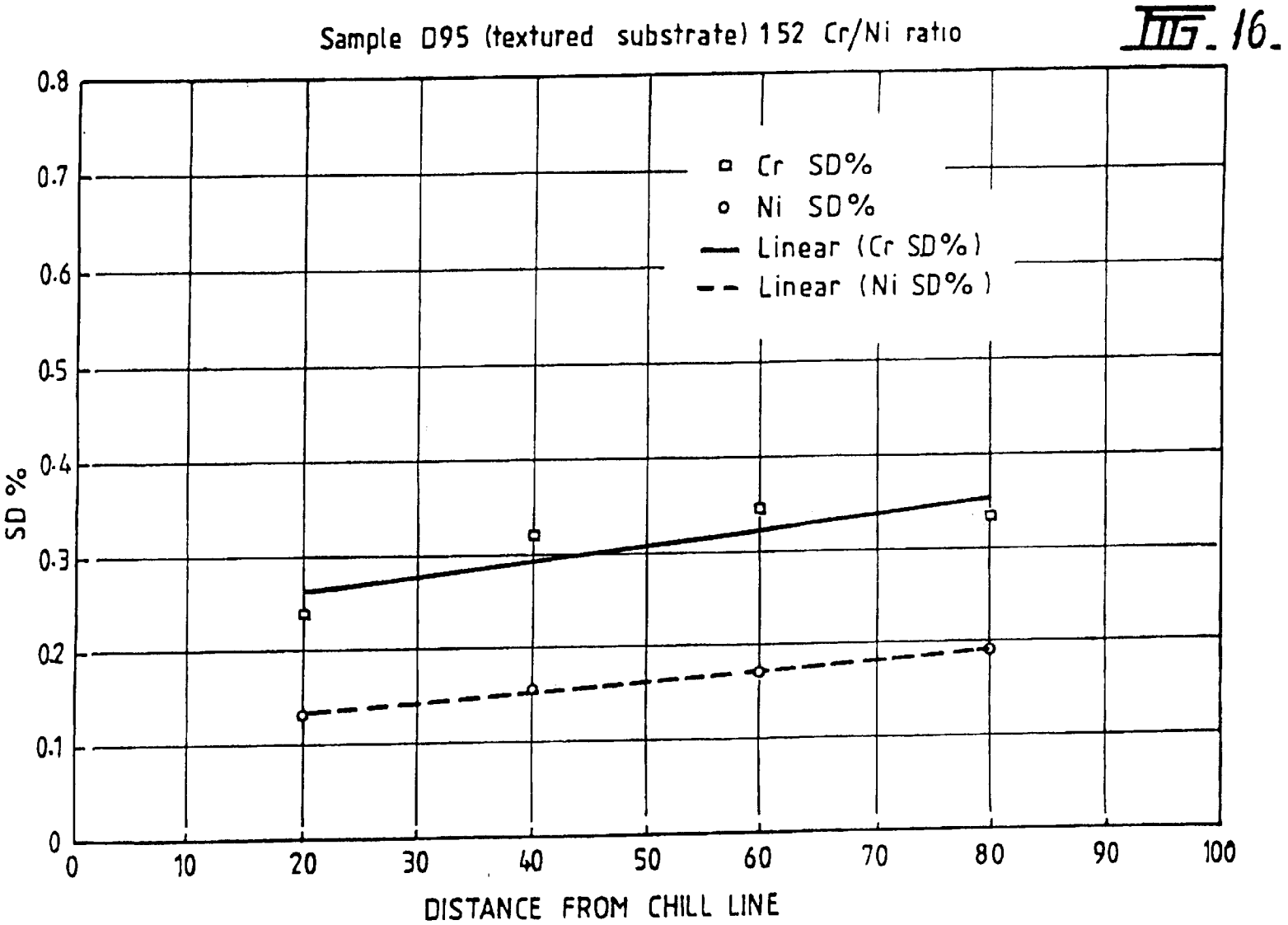

Specifically:

FIG. 16 plots the standard deviation for the Ni and Cr values in FIG. 10, FIG. 16 plots the standard deviation for the Ni and Cr values in FIG. 11, FIG. 16 plots the standard deviation for the Ni and Cr values in FIG. 12, FIG. 16 plots the standard deviation for the Ni and Cr values in FIG. 13, FIG. 16 plots the standard deviation for the Ni and Cr values in FIG. 14, FIG. 16 plots the standard deviation for the Ni and Cr values in FIG. 15.

It will be seen from FIG. 10 that the sample obtained by solidification from a melt having a Cr/Ni ratio of 1.52 onto a textured substrate produced little variation in the Cr and Ni measurements throughout the 100 micron depth from the chilled surface, indicating little microsegregation of these two elements in the surface regions of the sample. FIG. 16 provides a numerical measure of the variation. It will be seen that the percentage standard deviation for the Cr measurements range from 0.25 to 0.35 and for Ni range between 0.1 and 0.2. These results are dramatically better than the results obtained from any of the other samples.

Figure 17:
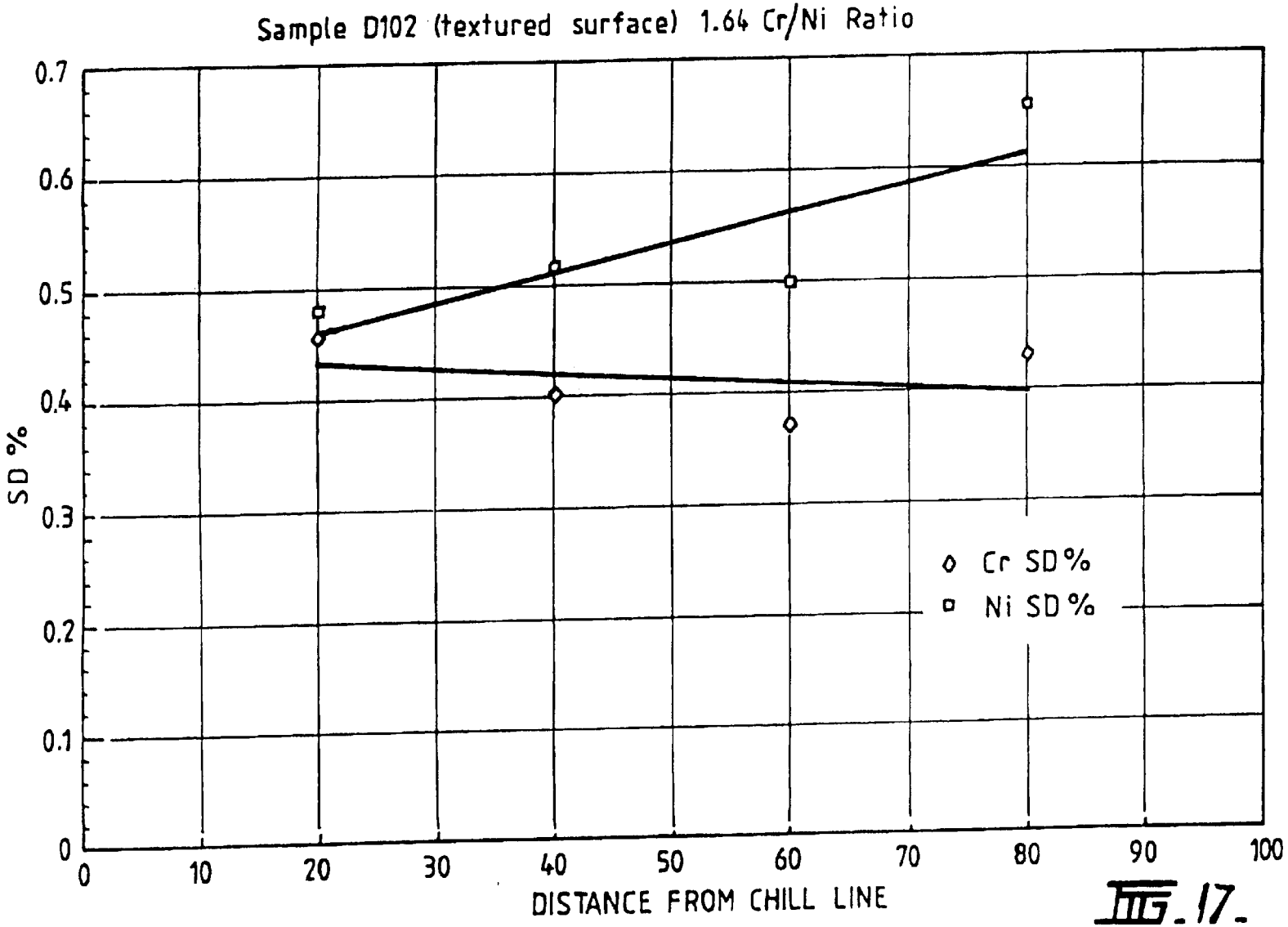
Figure 18:
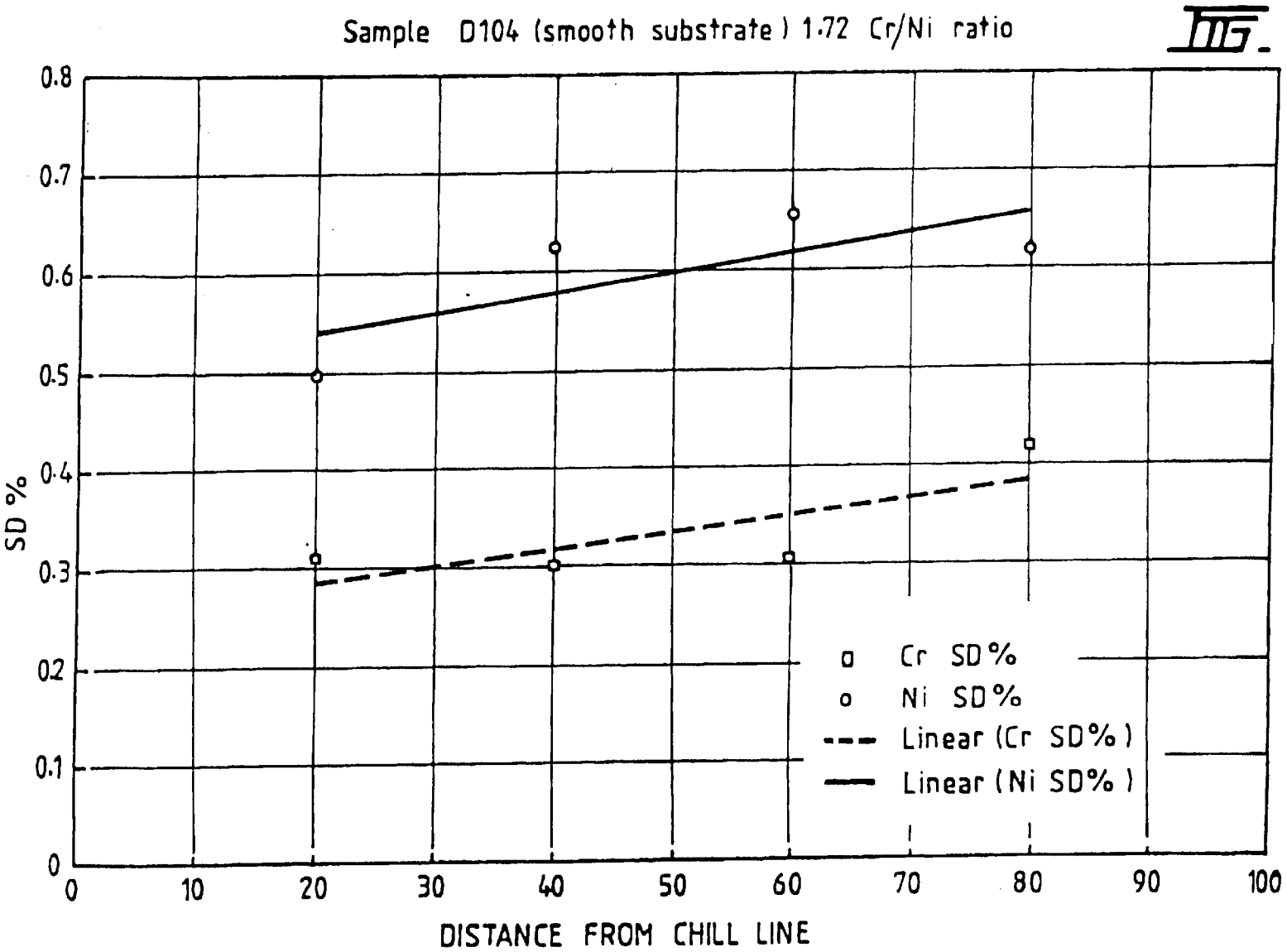
Figure 19:
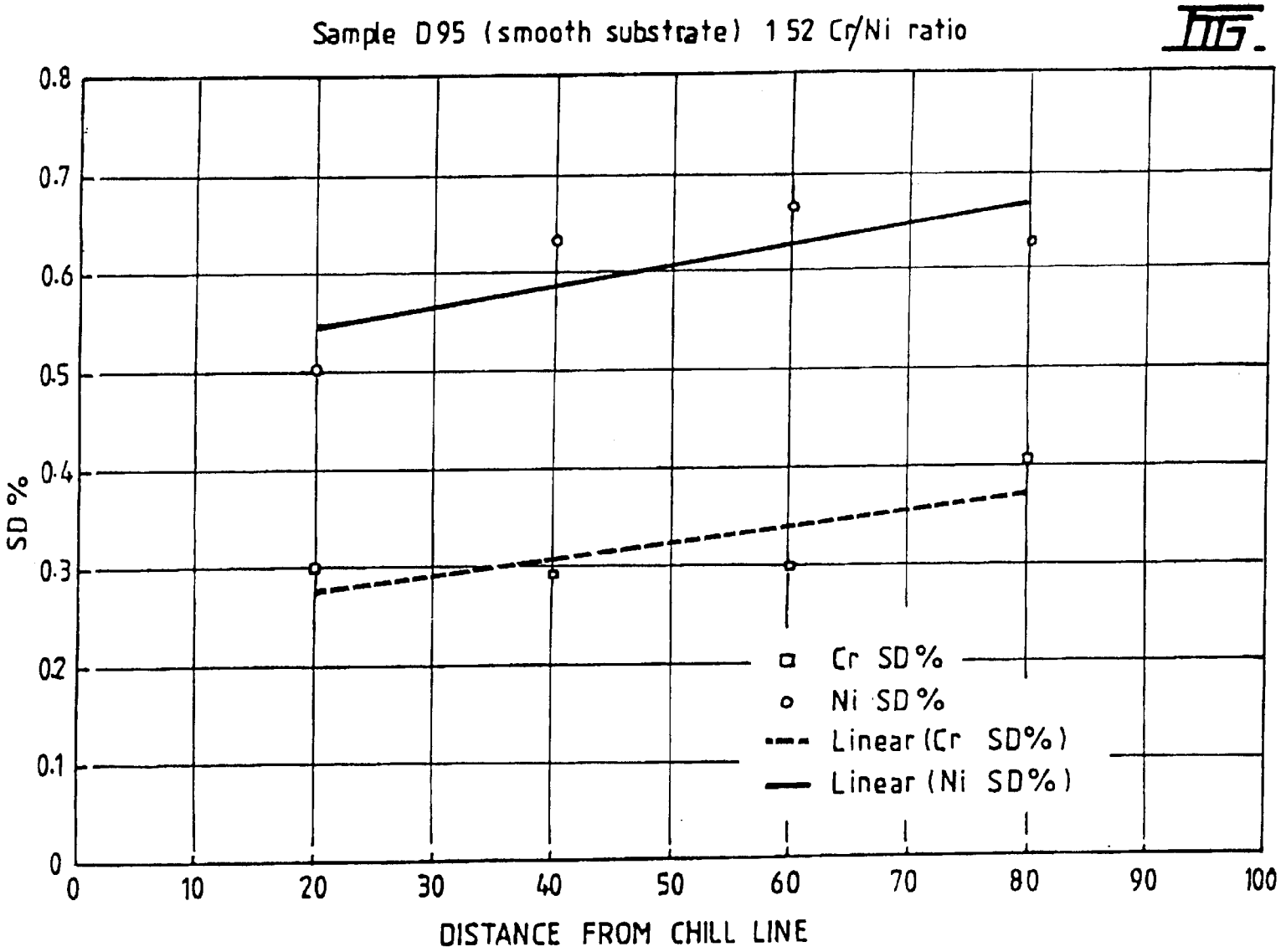
Figure 20:
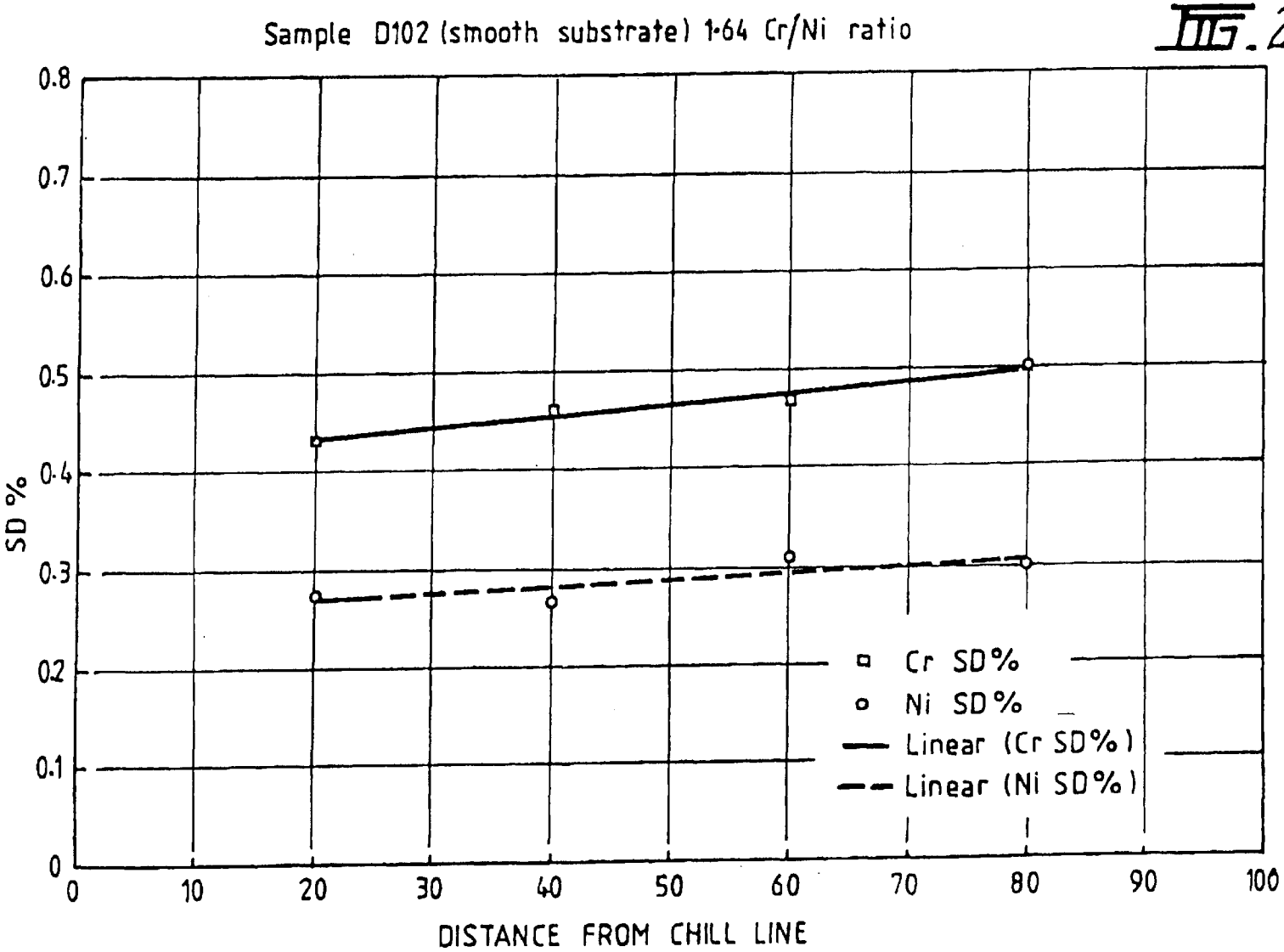
Figure 21:
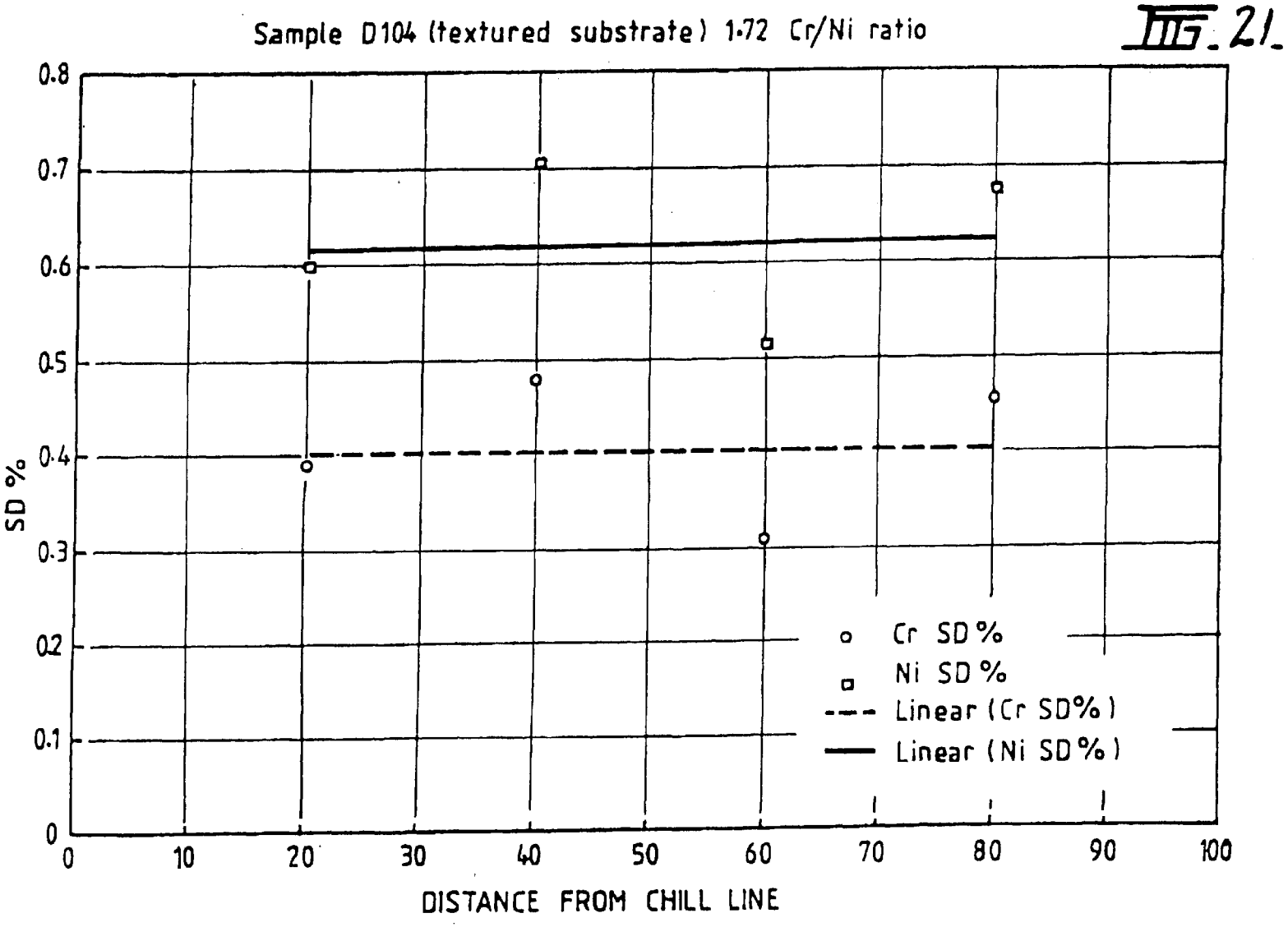

The results of FIGS. 11 and 17 for the sample produced from a melt having a 1.64 Cr/Ni ratio on a textured substrate produced deviation figures in excess of 0.4 for both Cr and Ni. The results in FIGS. 12 and 18 for the sample produced on a textured substrate from a melt having a 1.72 Cr/Ni ratio showed very high standard deviations in nickel content.

The results given in FIGS. 13 to 15 and 19 to 21 for samples produced on smooth substrates all evidence a wider variation than was achieved with the sample of FIGS. 10 and 16. The results plotted in FIGS. 13 and 19 were obtained from a sample deposited on a smooth substrate from a melt having a 1.52 Cr/Ni ratio during the same dip test as the sample deposited on a textured substrate for which results are plotted in FIGS. 10 and 16. It will be seen that the sample deposited on the smooth substrate produced a much wider variation of nickel content than the sample deposited on the textured substrate.

The sample deposited on a textured substrate from the melt having a Cr/Ni ratio of 1.52 exhibited a smooth surface texture whereas the other samples all exhibited surface cracking. The test results shown in FIGS. 10 to 21 confirm that such cracking is due to microsegregation of Cr and Ni during solidification and that in order to avoid this defect it is necessary to provide the combination of a textured casting surface to promote high initial heat transfer rates on solidification together with a melt chemistry having an unusually low chromium to nickel ratio of less than 1.6.

An important reason why a melt chemistry having a chromium to nickel ratio greater than 1.6 leads to segregation and distortion problems even with the high initial heat transfer ratio envisaged by the present invention is that there is a peritectic three-phase solidification region for chromium to nickel ratios of between about 1.5 and 1.9. With such steels, the liquid steel will initially start solidifying to both ferrite and austenite so that both of these phases will co-exist with the liquid melt. This provides severe deformation strains and segregation problems. However, with the extremely high initial heat transfer rates envisaged by the invention it is possible to accommodate some three-phase transformation and chromium to nickel ratios up to 1.6 can be tolerated.

In order to promote a high initial heat transfer rate in accordance with the invention it is important that the casting surface substrate consist primarily of copper and that the texture be cut into that primarily copper substrate. The textured substrate may be protected by a very thin protective coating which must not, however, be so thick as to significantly blur the surface texture to significantly reduce the high initial heat transfer rate required by the invention. A chromium plated coating of up to 100 microns thickness may accordingly be applied to the textured substrate.

We claim:

1. In a method of casting steel strip comprising:

forming a casting pool of molten steel in contact with a moving casting surface having a substrate consisting primarily of copper;

moving said casting surface relative to said casting pool;

solidifying steel from said casting pool on said moving casting surface; and taking solidified steel away from said moving casting surface;

the improvement comprising:

providing steel comprising austenitic stainless steel containing chromium and nickel in a ratio $(Cr/Ni)_{eq}$ of less than 1.6 in said casting pool;

contacting said austenitic stainless steel in said pool with said moving casting surface having a textured surface which has an Arithmetic Mean Roughness Value ($R_a$) of more than 2.5 microns provided by applying a texture to the substrate; and transferring heat from said austenitic stainless steel solidifying on said textured surface of said moving casting surface to said casting surface at an initial peak heat transfer rate of more than 15 $MW/m^2$ within the initial 20 ms of contact, said heat transfer rate being sufficiently high to enable the solidification of said steel on said surface without deleterious segregation and surface cracking.

2. The improved method as claimed in claim 1, wherein said texture is applied by forming in the substrate parallel groove and ridge formations of essentially constant depth and pitch, the depth of the texture from ridge peak to groove root being in the range 10 microns to 60 microns, and said pitch being in the range 100 microns to 200 microns.

3. The improved method as claimed in claim 2, wherein the carbon, chromium and nickel contents of the steel are in the following ranges:

| | |
|---|---|
| carbon | 0.04 to 0.06% by weight |
| chromium | 17.5 to 19.5% by weight |
| nickel | 8.0 to 10.0% by weight. |

4. The improved method as claimed in claim 1, wherein said texture is applied by cutting into or indenting the primarily copper substrate and covering the so formed textured surface with a thin protective coating which follows and preserves the texture.

5. The improved method as claimed in claim 4, wherein the protective coating is applied as a chromium plated coating with a thickness of no more than 100 microns.

6. The improved method as claimed in claim 1, wherein said texture is applied by cutting into the primarily copper substrate parallel groove and ridge formations of essentially constant depth and pitch, the depth of the texture from ridge peak to groove root being in the range 10 microns to 60 microns and said pitch being in the range 100 microns to 200 microns, and covering the so formed textured surface with a thin protective coating which follows and preserves the texture.

7. The improved method as claimed in claim 6, wherein the protective coating is applied as a chromium plated coating with a thickness of no more than 100 microns.

8. The improved method as claimed in claim 6, wherein the carbon, chromium and nickel contents of the steel are in the following ranges:

| | |
|---|---|
| carbon | 0.04 to 0.06% by weight |
| chromium | 17.5 to 19.5% by weight |
| nickel | 8.0 to 10.0% by weight. |

* * * * *